US006217533B1

(12) United States Patent
McCambridge

(10) Patent No.: US 6,217,533 B1
(45) Date of Patent: Apr. 17, 2001

(54) PORTABLE VIBRATING UNITS HAVING DIFFERENT SPEEDS

(75) Inventor: James E. McCambridge, Polo, IL (US)

(73) Assignee: Wahl Clipper Corporation, Sterling, IL (US)

( * ) Notice: Subject to any disclaimer, the term of this patent is extended or adjusted under 35 U.S.C. 154(b) by 0 days.

(21) Appl. No.: 09/195,069

(22) Filed: Nov. 18, 1998

(51) Int. Cl.[7] ..... A61H 1/00
(52) U.S. Cl. ..... 601/56; 601/70
(58) Field of Search ..... 601/56–61, 70, 601/78, 46, 48, 49, 65, 67

(56) References Cited

U.S. PATENT DOCUMENTS

| | | | |
|---|---|---|---|
| Re. 24,487 | | 6/1958 | Leach . |
| D. 390,965 | | 2/1998 | Raffel et al. . |
| 3,064,642 | | 11/1962 | Stewart . |
| 4,430,992 | * | 2/1984 | Christ . |
| 4,559,929 | | 12/1985 | Hseu . |
| 4,570,616 | | 2/1986 | Kunz et al. . |
| 5,014,687 | | 5/1991 | Raffel . |
| 5,140,976 | | 8/1992 | Cheng . |
| 5,140,977 | | 8/1992 | Raffel . |
| 5,181,504 | | 1/1993 | Ono et al. . |
| 5,188,096 | | 2/1993 | Yoo . |
| 5,437,607 | | 8/1995 | Taylor . |
| 5,437,608 | | 8/1995 | Cutler . |
| 5,462,515 | | 10/1995 | Tseng . |
| 5,545,125 | | 8/1996 | Tseng . |
| 5,730,707 | | 3/1998 | Vang . |

FOREIGN PATENT DOCUMENTS

| | | |
|---|---|---|
| 3316100 | 11/1984 | (DE) . |
| 3517774 | 11/1986 | (DE) . |

OTHER PUBLICATIONS

*Tranquil–East Mattress Massager Owners Manual and Operating Instructions;* Raffel Product Development Co., Inc.; Saukville, Wisconsin.

* cited by examiner

*Primary Examiner*—Danton D. DeMille
(74) *Attorney, Agent, or Firm*—Greer, Burns & Crain, Ltd.

(57) ABSTRACT

A bed massager includes two vibrating units and a control unit. Each vibrating unit has two motors oriented at 90° relative to each other. The motors in each power unit preferably have different power ratings, and can operate at different speeds. One motor in each unit is controlled to necessarily operate at a different speed than a corresponding motor in the other unit in at least one mode of operation, to avoid monotonous vibration and ensure that a pulse/wave effect is achieved. The other motors can be operated over a continuous range of speeds. The control unit provides individual control of the two vibrating units. In addition, the other motors in each vibrating unit can be separately and variably controlled. The vibrating units can easily be placed between a box spring and an upper mattress of a bed, horizontally separated at some distance. The device can also be used with a chair, a pillow or the like.

10 Claims, 3 Drawing Sheets

PORTABLE VIBRATING UNITS HAVING DIFFERENT SPEEDS

This invention relates to massagers, and more particularly, to bed massagers which create unique pulse/wave effects using two vibrating units which each contain two motors.

BACKGROUND OF THE INVENTION

Massagers arc available in a variety of configurations. For example, U.S. Pat. No. 5,730,707 discloses a device having two vibrating units which can be placed under a mattress or chair, wherein each motor/unit can be separately and variably controlled. Similarly, U.S. Pat. No. 5,545,125 describes a massaging device having two to sixteen motors which can be individually controlled. U.S. Pat. No. 5,462,515 discloses a massaging device having two vibrating units, and suggests that the motors which cause vibration can have different set powers or speeds. U.S. Pat. Nos. 5,140,976 and 4,559,929 disclose vibratory units having two motors, in which one motor is spaced at 90° relative to the other motor. However, all of these devices are limited in their ability to create unique pulse effects and wave effects, particularly with a simple, inexpensive control system. Accordingly, there is a need for a massaging device which provides unique pulse/wave effects. There is also a need for massaging devices which provide such unique effects with a simple, inexpensive control system.

Accordingly, one object of this invention is to provide new and improved massaging devices.

Another object is to provide new and improved massaging devices which create unique pulse/wave effects.

Still another object is to provide new and improved vibrating devices which create unique pulse/wave effects with a relatively simple, inexpensive control system.

SUMMARY OF THE INVENTION

In keeping with one aspect of the invention, a massaging device includes two vibrating units and a control unit. Each vibrating unit has two motors oriented at 90° relative to each other. The motors preferably have different power ratings, and are capable of operating at different speeds.

The control unit provides individual control of the two vibrating units. In addition, each motor in each vibrating unit can be separately and variably controlled. In at least one mode of operation, the speeds of a selected motor in each vibrating unit are fixed by the control system so that they necessarily operate at different speeds, out of phase with each other. The speeds of the other motors in the vibrating units are variably controlled over a range of speeds.

The vibrating units can easily be placed between a box spring and an upper mattress of a bed, horizontally separated at some distance. The device can also be used with a chair, a pillow or the like.

BRIEF DESCRIPTION OF THE DRAWINGS

The above-mentioned and other features of this invention and the manner of obtaining them will become more apparent, and the invention itself will be best understood by reference to the following description of an embodiment of the invention taken in conjunction with the accompanying drawings, in which.

DETAILED DESCRIPTION

Figure 1:
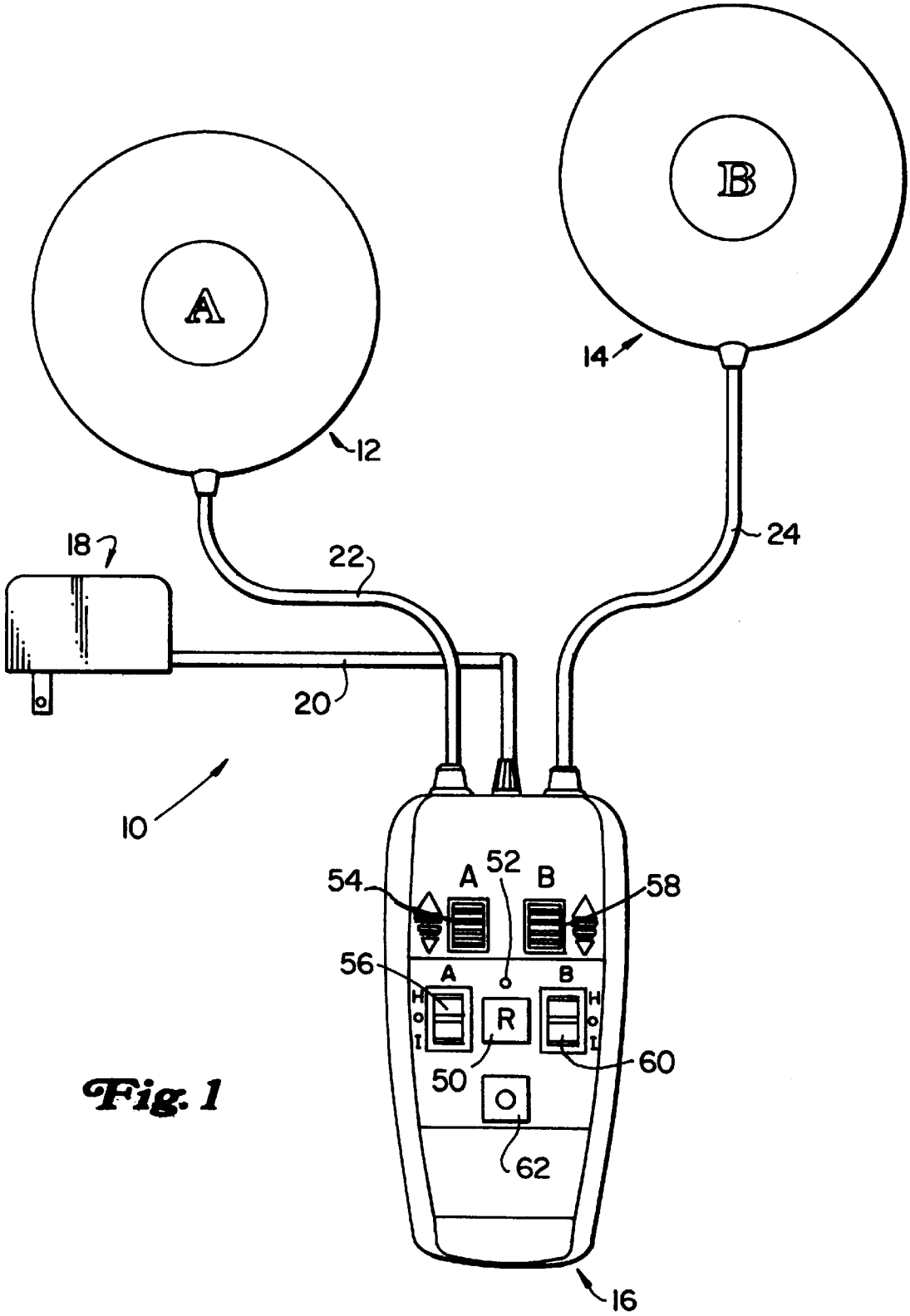
FIG. 1 is a diagram of a massaging device made in accordance with the principles of the invention.

As seen in FIG. 1, a massaging device 10 includes two vibrating units 12, 14, a control unit 16 and a power source 18. Electrical power is sent to the control unit 16 through a power line 20. The vibrating unit 12 receives power through a line 22, and the vibrating unit 14 receives power through a line 24.

Figure 2:
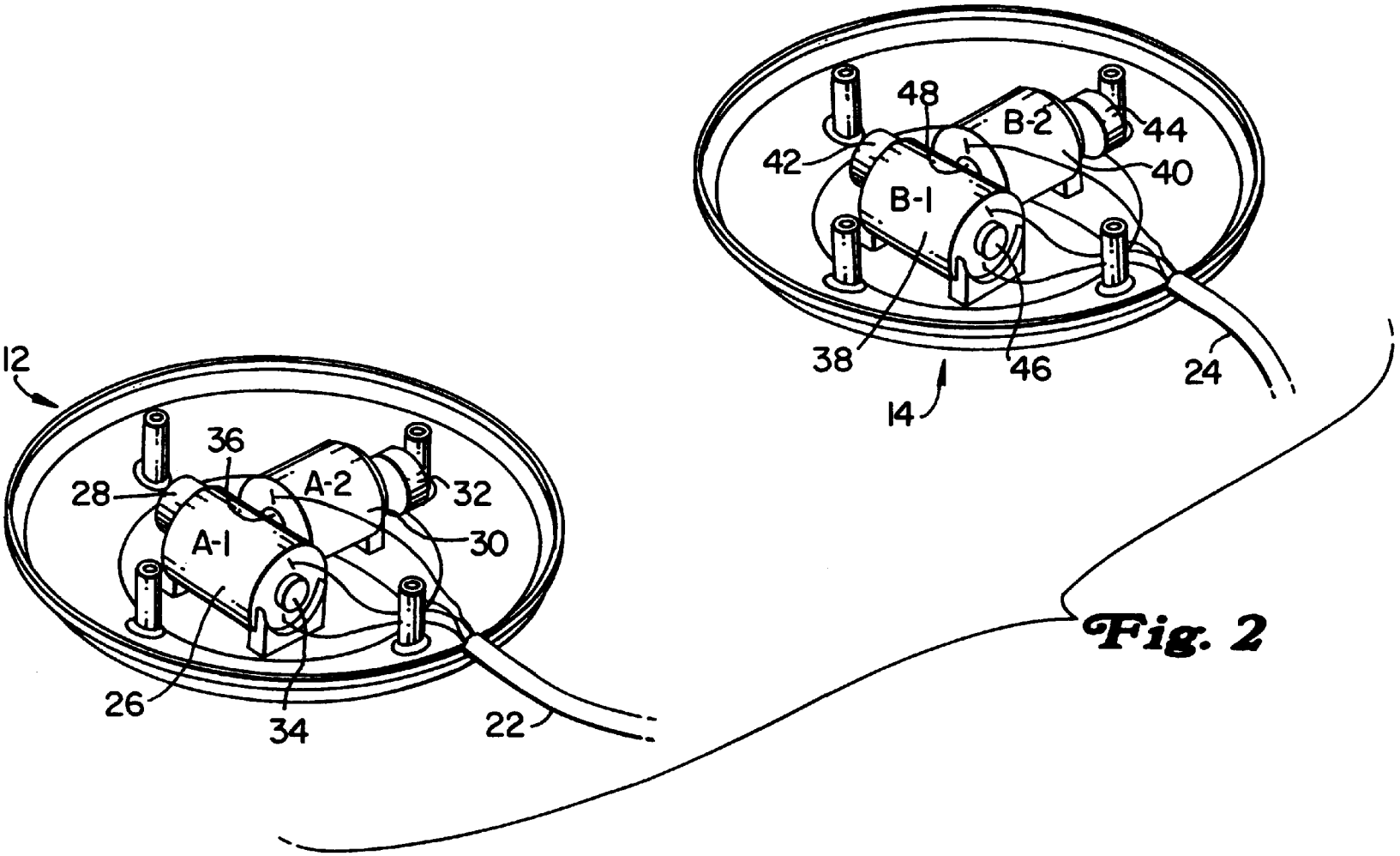
FIG. 2 is a detailed view of the vibrating units in the massaging device of FIG. 1.

The vibrating unit 12 (FIG. 2) includes a motor 26 which has an eccentric weight 28. The weight causes vibrations when the shaft of the motor 26 turns. A second motor 30 having an eccentric weight 32 is also included in the vibrating unit 12. The motor 26 has a shaft 34, and the motor 30 has a shaft 36. The shaft 36 is transverse to, and is preferably oriented at about a 90° angle to the shaft 34.

The motors 26 and 30 preferably produce different power levels, and can be operated over a range of speeds. For example, the motor 26 can be a large motor which is operable in either a high or a low setting, and the motor 30 can be a small motor having a continuously variable speed setting.

Similarly, the vibrating unit 14 includes motors 38, 40, which respectively include eccentric weights 42, 44, and shafts 46, 48 oriented at about 90° to each other. The motors 38, 40 are also different sizes, and can be operated over a range of speeds. The motor 38 can also be a large motor and the motor 40 can be a small motor. The motors 38, 40 can have speed ranges like those of the motors 26, 30.

Referring again to FIG. 1, the control unit 16 has a power on/reset switch 50, which preferably turns the unit on for a predetermined time period such as twenty minutes. An LED 52 indicates that the timer is running and power is on. An on/off/continuously variable speed control 54 is provided for the motor 30, and a high-low-off control 56 is provided for the motor 26. An on/off/continuously variable speed control 58 is provided for the motor 40, and another high-low-off control 60 is provided for the motor 38. A power off switch 62 is also provided, in order to turn the device off before the predetermined amount of time passes.

In one mode of operation, the variable speed controls 56, 60 are configured so that large motors 26 and 38 necessarily operate at different speeds for any combination of settings. This avoids the occurrence of monotonous vibration, so that a pulse/wave effect will occur at any setting.

For example, the motor 26 can be controlled to operate at about 3600 rpm at high speed and 3100 rpm at low speed. Correspondingly, the motor 38 can be controlled to operate at 3700 rpm at high speed and 3200 rpm at low speed. The speeds can be controlled easily and inexpensively by providing different voltages to the motors using a resistive voltage divider or the like.

The small motors 30, 40 can be controlled to operate at variable speeds from about 1200 rpm up to about 2500 rpm. Various known control methods can be used, such as pulse control.

In this mode of operation, the user can operate one or both of the large motors at high or low speed, with or without simultaneously operating one or both small motors at a desired speed within their operating ranges. However, when the large motors of the two vibrating units run simultaneously, an interesting pulse effect is achieved because the two large motors necessarily operate out of phase with each other. When both motors are running in both vibrating units, other interesting pulse/wave effects are created.

Figure 3:
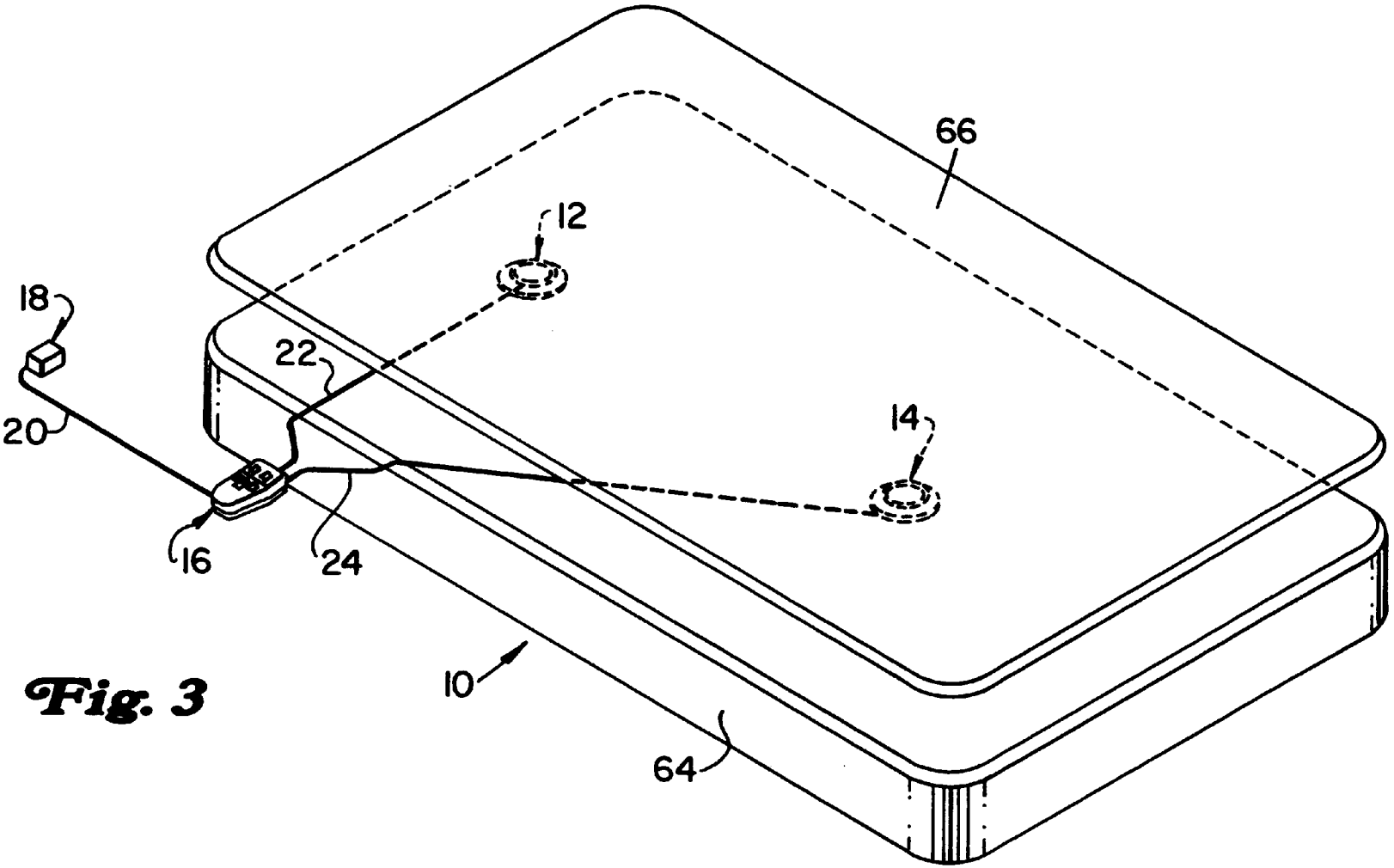
FIG. 3 is a perspective view showing the massaging device of FIG. 1 in use.

The massage device 10 can be used in a bed by placing the vibrating units 12, 14 between a box spring mattress 64 and a spring mattress 66, as in FIG. 3. The cables 22, 24 are preferably about 5½ and 6½ feet long, so that the control unit 16 can be easily kept outside of the mattresses. The vibrating units 12, 14 can be in any suitable place between the mattresses. For example, the vibrating unit 12 can be placed about 18 to 24 inches from the end of the mattresses, for placement under the head, with the vibrating unit 14 located about 24 to 36 inches away from the unit 12, in the area of the lower body or legs.

As another example, the vibrating units 12 and 14 can both be placed about 18 to 24 inches from the end of the mattress, with unit 12 placed 18 to 24 inches from the left edge of the mattress, for placement under one shoulder, and with the vibrating unit 14 located about another 24 inches away from the left edge of the mattress, in the area of the other shoulder. The massaging device 10 could also be used in a chair, with pillows, or a variety of other applications.

The massage unit 10 may be powered by line voltage or batteries, as desired. A low voltage source powered by line voltage, such as a 12 volt direct current converter, is preferred.

The many advantages of this invention are now apparent. The user has many choices and can create interesting pulse/wave effects. However, the user is assured of creating the out of phase effect because the control system limits and predetermines the speeds of the large motors. The control system is easy to operate, and is inexpensive because of its straightforward design.

While the principles of the invention have been described above in connection with specific apparatus and applications, it is to be understood that this description is made only by way of example and not as a limitation on the scope of the invention.

What is claimed is:

1. A massaging device comprising:

a first vibrating unit including at least a first motor having at least two predetermined speeds; and a second vibrating unit including at least a second motor having at least two predetermined speeds, wherein both of said at least two predetermined speeds of said first motor are different from both of said at least two predetermined speeds of said motor, such that said first motor and said second motor never operate at the same speed, further wherein said first and second motors each have a shaft and at least one eccentric weight on said shaft, whereby said eccentric weights cause said first and second vibrating units to vibrate, and wherein said first vibrating unit has a third motor, said second vibrating unit has a fourth motor, and said third and fourth motors each have speeds which are continuously variable over a range of speeds.

2. A massaging device comprising:

a first vibrating unit including at least a first motor, and a second vibrating unit including at least a second motor, said motor having at least two first predetermined speeds, said second motor having at least two predetermined speeds, both of said at least two predetermined speeds of said first motor being different from both of said at least two predetermined speeds of said second motor, such that said first motor and said second motor never operate at the same speed, said first vibrating unit having a third motor oriented at a transverse angle to said first motor, and said second vibrating unit having a fourth motor oriented at a transverse angle to said second motor, said third and fourth motors having speeds which are continuously variable over a range of speeds, said first, second, third and fourth motors each having a shaft and at least one eccentric weight on said shaft, said eccentric weights causing said first and second vibrating units to vibrate.

3. The massaging device of claim 1 wherein said transverse angles are about 90 degrees.

4. The massaging device of claim 1 comprising means for automatically turning said first and second vibrating units off after a predetermined time.

5. The massaging device of claim 1 wherein the difference between said predetermined speeds of said first motor and said predetermined speeds of said second motor is about 100 rpm.

6. The massaging device of claim 1 wherein said speed range of said third and fourth motors is between about 1200 rpm and about 2500 rpm.

7. The massaging device of claim 1 wherein said first and second vibrating units are connected to a control unit by cables which are about 5½ to 6½ feet long, so that the massaging device can be used in a bed with said first vibrating unit placed under a user's head, and said second vibrating unit placed about 24 to 36 inches from said first vibrating unit.

8. The massaging device of claim 1 comprising a power source.

9. The massaging device of claim 8 wherein said power source is a low voltage source powered by line voltage.

10. The massaging device of claim 8 wherein said power source includes at least one battery.

* * * * *

UNITED STATES PATENT AND TRADEMARK OFFICE

CERTIFICATE OF CORRECTION

PATENT NO. : 6,217,533 B1
DATED : April 17, 2001
INVENTOR(S) : James E. McCambridge It is certified that error appears in the above-identified patent and that said Letters Patent is hereby corrected as shown below:

Column 4,
Lines 25, 27, 30, 34, 37 and 44, delete "claim 1" and insert -- claim 2 -- therefor;

Signed and Sealed this

Seventh Day of May, 2002

*Attest:*

*Attesting Officer*

JAMES E. ROGAN
*Director of the United States Patent and Trademark Office*